US005199342A

United States Patent [19]

Hediger

[11] Patent Number: 5,199,342

[45] Date of Patent: Apr. 6, 1993

[54] METHOD FOR CUTTING A WORKPIECE AND AN APPARATUS FOR PERFORMING THE METHOD

[76] Inventor: Peter Hediger, Fabrikweg 15, 5033 Buchs, Switzerland

[21] Appl. No.: 738,478

[22] Filed: Jul. 31, 1991

[30] Foreign Application Priority Data

Jul. 31, 1990 [EP] European Pat. Off. ..... 90810576.0

[51] Int. Cl.[5] ..... B26F 3/00

[52] U.S. Cl. ..... 83/177; 83/53

[58] Field of Search ..... 83/53, 177; 51/410, 51/439; 239/227, 264

[56] References Cited

U.S. PATENT DOCUMENTS

| | | | |
|---|---|---|---|
| 3,985,848 | 10/1976 | Frische et al. | 83/177 |
| 4,058,040 | 11/1977 | Fisher | 83/177 |
| 4,182,170 | 1/1980 | Grupp | 83/177 |
| 4,728,379 | 3/1988 | Audi et al. | 83/53 |
| 4,738,174 | 4/1988 | Bloomquist | 83/177 |

FOREIGN PATENT DOCUMENTS

| | | | |
|---|---|---|---|
| 0207069 | 12/1986 | European Pat. Off. | 83/177 |

*Primary Examiner*—Frank T. Yost
*Assistant Examiner*—Allan M. Schrock
*Attorney, Agent, or Firm*—Tarolli, Sundheim & Covell

[57] ABSTRACT

To cut or separate a workpiece, having a plain or curved surface, a jet-like fluid cutting medium is used. The cutting medium is ejected from a nozzle under high pressure and is directed towards the workpiece. In order to achieve an exact cut edge, even if a high cutting speed is selected, the cutting medium is directed towards the surface of the workpiece not exactly perpendicularly, but with an angle deviation of between 0.1 and 0.3 degrees. An apparatus for performing such a cutting operation comprises a tube with a nozzle at its end through which the cutting medium is ejected. The nozzle is swivelably supported and the tube may be adjusted in X- and Y-direction such that the desired cutting angle may be controlled.

8 Claims, 2 Drawing Sheets

2/2
Fig. 3
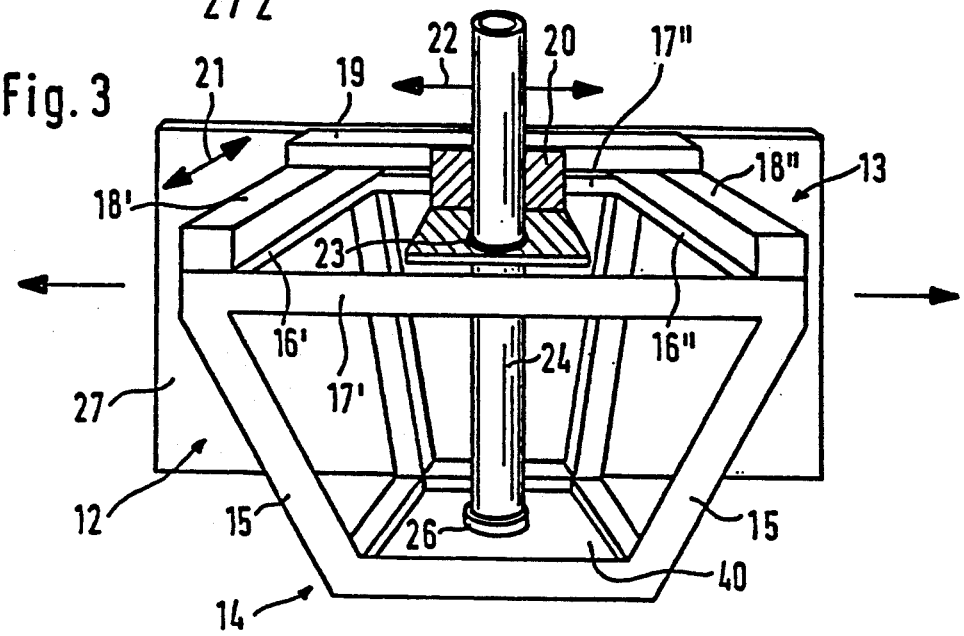
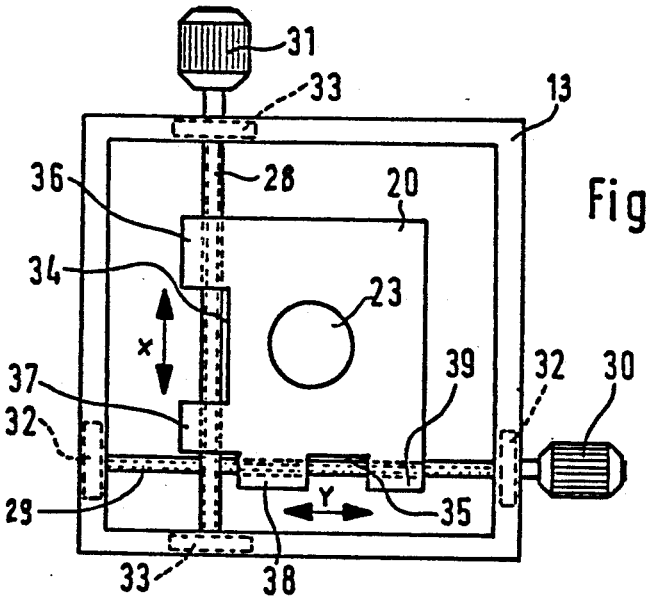
Fig. 5
Fig. 4
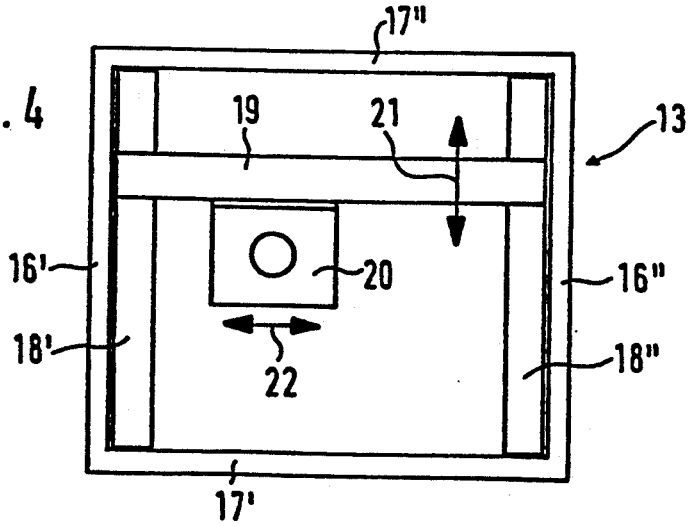

METHOD FOR CUTTING A WORKPIECE AND AN APPARATUS FOR PERFORMING THE METHOD

BACKGROUND OF THE INVENTION

The present invention refers, in a first aspect, to a method for cutting a workpiece by means of a beam-shaped fluid cutting medium ejected under high pressure out of a nozzle, whereby there is provided a high-pressure fluid jet escaping from the nozzle, whereby the high-pressure fluid jet is directed against the workpiece, and whereby the nozzle is moved over the surface of the workpiece along a predetermined path.

According to a second aspect, the invention refers to an apparatus for cutting a plain, curved or arched workpiece by means of a beam-shaped fluid cutting medium ejected under high pressure out of a nozzle. This apparatus comprises a nozzle provided at the end of a tube-like member and means for providing a high-pressure fluid jet escaping from the nozzle.

It is well known in the prior art to cut or separate workpieces in a touchless method by means of a fluid jet, a gas jet or a laser beam, said jet or beam being directed towards the workpiece to be cut and being moved along a desired path. Probably the most common apparatusses of this kind are the water jet cutting apparatusses which use a water jet ejected from a nozzle under a pressure of up to 4000 bar. Thereby, it is possible to cut workpieces of different kind, e.g. styropor, wood, fabrics, leather, rubber, textiles and many more.

It is also known in the prior art art to admix an abrasive medium to this fluid jet, e.g. quartz, glass dust, corundum etc. in order to be able to cut harder materials like metal, glass, stone and the like.

According to the prior art, it has been taught to direct the fluid jet exactly perpendicularly towards the surface of the workpiece to be cut in order to get an exact and clean cut edge. This perpendicular position had to be maintained during the entire cutting process, even if the movement of the cutting jet is controlled by a CAD-machine.

However, experience has shown that this is not true; in this manner, it is not possible to achieve a cleanly cut edge. Particularly, the edges of the cut workpieces are not exactly cut, are irregular and do not extend exactly perpendicularly to the plain surface of the workpiece.

As can be seen from FIG. 1, for example, in cutting a plate-like workpiece 1 by means of a fluid jet-like cutting medium 2 being ejected from a nozzle 3, it is not possible to achieve an exactly cut edge surface 4 because, as a result, the angle 5 is smaller or larger than 90° with reference to the surface 6 of the workpiece 1. This situation is schematically shown in FIG. 1. However, if it is required to very exactly cut a workpiece, the aforementioned disadvantages occur particularly aggravatingly. If, for example, precisely shaped parts have to be cut out of a workpiece according to a complicated shape which, thereafter, have to be inserted into correspondingly negative shaped workpieces or which have to be assembled with other precise workpieces, it is of paramount importance that the cut edges exactly run parallelly with regard to the workpieces.

For example, if cut-out parts, e.g. letters, are to be inserted into corresponding cut-outs of a base plate in order to manufacture inlays or high relief printings, the cut edges of the letters are allowed to be inclined inwards, but not outwards. With other words, deviations from the perpendicular direction can be tolerated in one, but only in one direction and not in the other direction. However, according to the prior art, deviations from the perpendicular direction of the cut edge surface can not be avoided because no reliable and economic method exists to provide an exactly perpendicular and clean cut edge.

The only method to avoid the aforementioned disadvantages known in the prior art was to drastically reduce the cutting speed during the cutting or separating process. A cut edge surface which is practically usable can be achieved, according to the prior art, if the theoretically possible cutting speed, depending on the material to be cut and on the cutting medium used, is not really exploited, but considerably reduced. However, such a proceeding results in a considerably loss of efficiency with the consequence that the final product becomes much more expensive. The reason is that the very expensive cutting apparatusses can not be used according to their theoretical possibilities.

OBJECTS OF THE INVENTION

It is an object of the present invention to provide a method for cutting a plain or curved workpiece by means of a beam-shaped fluid cutting medium ejected under high pressure out of a nozzle means which method avoids the aforementioned disadvantages.

It is a further object of the present invention to provide a method for cutting a plain or curved workpiece by means of a beam-shaped fluid cutting medium ejected under high pressure out of a nozzle means which method allows to use a considerably higher cutting speed without the disadvantage that the cut edge surface is irregular.

It is a still further object of the invention to provide an apparatus for cutting a plain, curved or arched workpiece by means of a beam-shaped fluid cutting medium ejected under high pressure out of a nozzle means which apparatus enables to cut a workpiece with a high cutting speed and with resulting clean and regular cut edge surfaces.

SUMMARY OF THE INVENTION

To achieve these and other objects, the invention provides, according to a first aspect, a method for cutting a plain workpiece by means of a beam-shaped fluid cutting medium ejected under high pressure out of a nozzle. Thereby, there is provided a source known in the art for a high-pressure fluid jet escaping from the nozzle. The high-pressure fluid jet is directed against the workpiece and the nozzle is moved over the surface of the workpiece along a predetermined path.

The essential point is that the direction of the axis of the high-pressure fluid jet encloses an angle with a line running perpendicular to the surface of the workpiece to be cut during the entire cutting process, i.e. that the high-pressure fluid jet is not directed exactly perpendicularly towards the workpiece.

Preferably, the nozzle is directed against the surface of the workpiece such that the angle between the axis of the fluid jet and the line running perpendicular to the surface of the workpiece amounts to between 0.1 and 0.3 degrees.

The method as set forth hereinabove can also be used for curved or arched workpieces. Basically, there is no great difference, except that the direction of the axis of the high-pressure fluid jet always encloses an angle with a line running perpendicular to a tangential plane of the surface of the workpiece to be cut during the entire cutting process.

According to a second aspect of the invention, there is provided an apparatus for cutting a plain, curved or arched workpiece by means of a beam shaped fluid cutting medium ejected under high pressure out of a nozzle means. This apparatus comprises a nozzle provided at the end of a tube-like member and means known in the art for providing a high-pressure fluid jet escaping from the nozzle.

Furthermore, means are provided by which an end portion of the tube-like member which is provided with the nozzle is pivotally supported and by which the tube-like member itself is supported in a guiding member which is pivotal in all directions.

Preferably, the means by which that end of the tube-like member which is provided with the nozzle is pivotally supported and by which the tube-like member itself is supported in a guiding member which is pivotal in all directions comprise a pyramid-shaped cage-like supporting member including a lower supporting plate for pivotally supporting the end portion of the tube-like member being provided with the nozzle as well as an upper guiding member adjustable in two directions running perpendicularly to each other by means of which the tube-like member is pivotal in all directions and displaceable in axial direction.

The pyramid-shaped cage-like supporting member can comprise a supporting plate which is operationally connected to a CAD control means.

According to a preferred embodiment, the pyramid-shaped cage-like supporting member comprises an upper tetragonal frame member and a lower frame member, said lower frame member being smaller than said upper frame member and the upper and lower frame members being connected to each other by means of bar members. Thereby, the upper tetragonal frame member comprises guiding elements running parallel to each other. These are adapted to receive a supporting bridge member. Preferably, there is provided a L-shaped supporting plate connected to the supporting bridge member and being slidably connected thereto. The L-shaped supporting plate has an aperture for receiving the tube-like member such that it is displaceable in axial direction and pivotal in all directions.

According to another embodiment, the upper tetragonal frame member has square or rectangular shape and comprises a first pair of parallely running frame side bars extending in X-direction and a second pair of parallely running frame side bars extending in Y-direction, said X- and Y-directions being perpendicular to each other. Thereby, the upper frame member comprises a first spindle and a first driving motor adapted to rotate the first spindle, said first spindle extending in the X-direction, and a second spindle and a second driving motor adapted to rotate said second spindle. The first spindle extends in Y-direction, whereby the first spindle is parallely displaceable along the second frame side bars in the Y-direction and whereby the second spindle is parallely displaceable along the first frame side bars in the X-direction.

In order to displace the L-shaped supporting plate in all directions, it comprises two threaded protrusions projecting from two adjacent edges thereof. The first spindle is operatively connected to one of said protrusions and the second spindle is operatively connected to the other one of said protrusions.

In order to enable the tube-like member and, therewith, the nozzle to be swivelable in all directions, the end portion of the tube like member which is provided with the nozzle or the nozzle itself is received in a bearing shell provided in the lower supporting plate in a flexible and clearance-free manner.

BRIEF DESCRIPTION OF THE DRAWINGS

In the following, an embodiment of the method and the apparatus of the invention will be described in greater detail, with reference to the accompanying drawings, in which:

FIG. 3 shows a schematic partial view of an embodiment of the apparatus according to the invention;

FIG. 4 shows a top view of the embodiment as shown in FIG. 3;

FIG. 5 shows a similar view as in FIG. 4 in another embodiment; and

DETAILLED DESCRIPTION OF THE PREFERRED EMBODIMENTS

Figure 1:
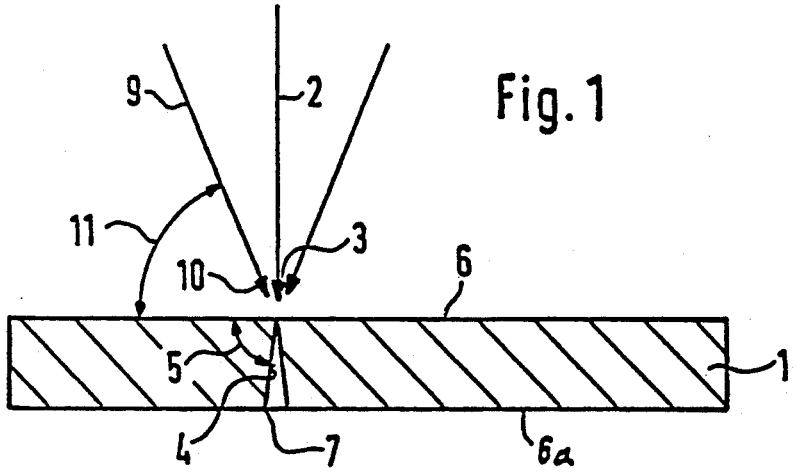
FIGS. 1+2 show a purely schematic sketches to explain the method.

In order to explain the problems which are to be solved with the present invention, it has already been said hereinbefore in connection with FIG. 1 that, during cutting a panel 1 consisting e.g. of metal or stone and having a thickness of between a few millimeters up to a few centimeters, an exactly cut surface 4 cannot be realized because at least in the region of the cutting edge 7, i.e. where the cut surface 4 meets the surface 6a of the panel 1, the cut surface 4 does not run exactly perpendicular to the surface 6a of the panel. This is a real problem and the only way to avoid this problem is to drastically reduce the cutting speed. However, the result is that the manufacturing costs of an object cut by means of a beam-shaped fluid cutting medium are considerably higher.

Figure 2:
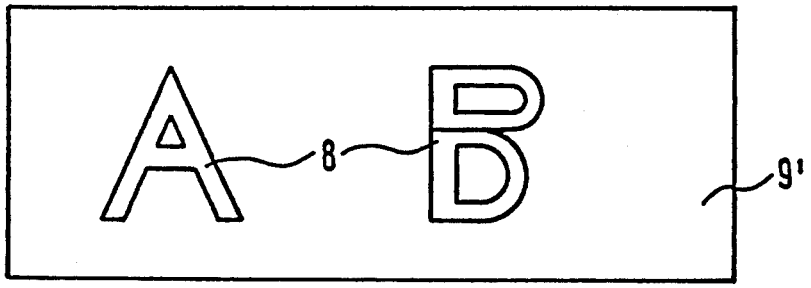

If for example letters 8 or other shapes have to be cut out of a workpiece 9' (FIG. 2) which thereafter have to be inserted into corresponding apertures in an other workpiece, it is not avoidable to manually finish the cutting edges not only of the letters etc. but also of the apertures in said other workpiece. Similar or even greater difficulties are encountered if constructional workpieces have to be cut from a raw panel which workpieces, thereafter, have to put together to an operative unit whereby the sizes and dimensions of the individual workpieces have to be met very exactly.

In order to avoid these difficulties and drawbacks, it is proposed according to the invention in a method in which a high pressure fluid jet is directed against a workpiece, e.g. a panel, an in which the fluid jet is moved along a desired path over the workpiece, that the axis of the high-pressure fluid jet runs not exactly perpendicularly to the surface (in the case of a plain workpiece) or to the tangential plane of the surface (in the case of a curved or arched workpiece), but encloses a slight angle with the perpendicular line.

Referring now again to FIG. 1, it can be seen that the panel 1, i.e. the workpiece, has a plain surface 6. In order to cut this panel 1, a fluid cutting medium, e.g. a water jet 9 escaping from a nozzle 10 is directed against the surface 6 of the panel 1. However, the axis of the water jet 9 runs not perpendicular to the surface 6 of the panel 11, but encloses an angle 11 with the plain surface 6 which is slightly smaller than 90°. It is understood that the purely schematic sketch in FIG. 1 is heavily exaggerated for the sake of clarity. In practice, the angle 11 will be in the region between 89.7° and 89.9°; with other words, the fluid jet 9 is directed against the surface 6 of the workpiece such that the angle between the axis 9 of the fluid jet and the line 2 running perpendicular to the surface 6 of the workpiece 1 amounts to between 0.1 and 0.3 degrees.

Surprisingly, it has been found that such a deviation of the angle results in a perfectly plain cut surface 4 running perfectly parallel with regard to the surface 6 of the panel 1, even if the greatest possible cutting speed is used which is determined by the material of the panel 1, by the cutting fluid and by the shape of the cutting line. This deviation from the aforementioned perpendicular orientation is maintained during the entire cutting process.

If the surface 6 of the workpiece 1 is not plain but curved or arched, then the reference for the direction of the cutting jet is the tangential plane to the curved or arched surface portion to be cut. With other words, the direction of the cutting jet is referenced to a line running perpendicularly to said tangential plane and the axis of the cutting jet is adjusted such that it deviates from this perpendicular line by an amount of between 0.1 and 0.3 degrees, depending of the material of the workpiece to be cut. This deviation is continuously adjusted to be always constant with reference to the perpendicular line to the tangential plane.

In order to perform the method according to the invention, there is provided an apparatus which is shown in FIG. 3 in a schematic partial view of an embodiment of the apparatus according to the invention an in FIG. 4 in a top view of the embodiment as shown in FIG. 3. The apparatus comprises a cage-like supporting member 12 having the shape of a pyramid. The cage-like supporting member 12 comprises an upper tetragonal frame 13, a similar lower tetragonal frame 14 as well as a number of connecting struts 15 which obliquely run from upwards, from the upper frame 13, down to the lower frame 14.

The upper tetragonal frame 13 consists of two pairs of opposite parallely running struts 16', 16" and 17', 17", respectively, whereby the struts 16' and 16" each are provided with a guide member 18', 18", respectively. A supporting bridge 19 is mounted in the guide members 18' and 18" and is parallely displaceable in the direction of the double arrow 21. A L-shaped mounting plate 20 is mounted on the supporting bridge and displaceable therealong. The vertical portion of the mounting plate 20 is fixed to the supporting bridge 19 and can be displaced, together with the supporting bridge 19, in the direction of the double arrow 21. On the other hand, the L-shaped mounting plate can be displaced perpendicularly thereto, shown by the double arrow 22, along the supporting bridge 19.

Figure 6:
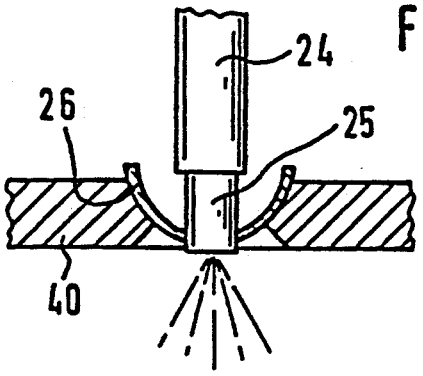
FIG. 6 shows a detail relating to FIG. 3 in an enlarged partial sectional view.

The horizontally extending portion of the L-shape mounting plate 20 is provided with a circular aperture 23 through which a tube-like member 24 for the cutting medium extends; the tube-like member 24 is axially displaceable. The free end of the tube-like member 24 is provided with a nozzle 25 (cf. FIG. 6) through which the cutting medium, e.g. water, escapes with high pressure, for instance with a pressure of about 4000 bar, if required with an abrasive agent mixed to the water jet.

The tube-like member 24 is supported at its lower end in the region where the nozzle 25 is connected thereto. For this purpose, a plate-like member 40 is provided which comprises a bearing shell 26. Thereby, the tube-like member 24 is pressed against the bearing shell 26, and the the bearing shell 26 a well the tube-like member 24 is swivable with reference to the plate-like member 40. Preferably, the tube-like member 24 is pressed against the bearing shell 26 by means of a (not shown) spring member.

Thus, as hereinbefore described, the tube-like member 24 can be adjusted as required, i.e. in the X-direction (direction of arrow 22) by displacing the mounting plate 20 along the supporting bridge 19 and in the Y-direction (direction of arrow 21) by the supporting bridge along the guide members 18' and 18". By means of the provision of the bearing shell 26, the tube-like member 24 can be freely swivelled in the aperture 23.

The apparatus as hereinbefore described is preferably mounted on the mounting plate 27 which is controlled by a CAD-machine. This CAD-machine is programmed, in accordance with a given pattern, to perform the cutting operation. In the prior art, the cutting medium, i.e. the fluid jet, is directed to the material to be cut exactly perpendicularly. However, according to the present invention, the cutting medium, i.e. the fluid jet is not directed exactly perpendicularly to the surface of the material to be cut, but under a slight angle amounting to about 0.1 to 0.3 degrees. Thereby, the adjustment of the direction of the fluid jet is performed by means of the aforementioned adjusting means in the directions of the arrows 21 and 22. By the said deviation of 0.1 to 0.3 degrees, a cone is defined the generatrix of which fulfilling the desired requirements. Usually, according to the invention, it doesn't matter which generatrix is chosen, and it is also possible, by means of a trial-and-error method, to choose the most suitable generatrix from the sheaf thereof.

It is also possible to perform a displacement in a third dimension (Z-axis) by providing means for a height adjustment of the mounting plate 27. Such height adjustment can be coordinated with the movements controlled by the CAD-machine.

A further embodiment of the invention is shown in FIG. 5. Thereby, a frame 13 is provided, said frame 13 comprising a pair of spindles, e.g. a first spindle 28 and a second spindle 29. The first spindle 28 extends in the X-direction and the second spindle 29 extends in the Y-direction, perpendicular to the X-direction. Both spindles 28 and 29 are provided with a driving motor 30 and 31, respectively, adapted to rotate the spindles.

The first spindle 28 running in X-direction is supported, at both ends, in bearings 33, e.g. roller bearings, plain bearings or the like such that it is parallely displaceable in the Y-direction within the frame 13. The second spindle 29 running perpendicularly to the first spindle 28 in Y-direction is supported, at both ends, in bearings 32, e.g. roller bearings, plain bearings or the like such that it is parallely displaceable in the X-direction within the frame 13.

The mounting plate 20 comprises two sides 34 and 35 running perpendicularly to each other. These sides 34 and 35 are operatively connected to the spindles 28 and 29. For this purpose, these sides 34 and 35 are provided with protrusions 36 and 37; and 38 and 39, respectively, having a threaded bore in which the two spindles 28 and 39, respectively, engage. The spindles 28 and 39 are axially fixed. Thus, by rotating the spindles 28 by means of the motor 31, the mounting plate 20 is displaced in X-direction. Correspondingly, by rotating the spindles 29 by means of the motor 30, the mounting plate 20 is displaced in X-direction. In this manner, by means of the aforementioned CAD-machine which controls the motors 30 and 31, a very exact displacement of the mounting plate 20 with the circular aperture 23 and, thereby, of the direction of the fluid jet, can be achieved.

As it has been described hereinbefore, it is possible, according to the method and apparatus of the invention, to adjust the cutting medium exactly such that a cutting edge running exactly perpendicularly to the surface of the object to be cut can be achieved. Furthermore, it is possible to achieve a cutting edge which runs slightly conically outwards or inwards, as desired. The cutting medium can be a water jet or another fluid jet, with or without addition of an abrasive medium, or oven a laser beam. It is understood that the term "cutting" includes all operations like, for example, separating, disassembling, milling or the like.

What is claimed is:

1. An apparatus for cutting a plain, curved or arched workpiece by a beam-shaped fluid cutting medium ejected under high pressure, said apparatus comprising:
- a tube-like member having an end portion and an inlet for receiving fluid;
- nozzle means connected at said end portion of said tube-like member;
- means for providing a high-pressure fluid jet escaping from said nozzle means;
- guiding means including an upper guiding member adjustable in two directions extending perpendicular to each other for enabling said tube-like member to displace in axial direction; and
- supporting means comprising a pyramid-shaped cage-like supporting member including a lower supporting plate for supporting for pivotal movement in all directions said end portion of said tube-like member at which said nozzle means is connected.

2. An apparatus according to claim 1 wherein said pyramid-shaped cage-like supporting member comprises a mounting plate which is operationally connected to a CAD control means.

3. An apparatus for cutting a plain, curved or arched workpiece by a beam-shaped fluid cutting medium ejected under high pressure, said apparatus comprising:
- a tube-like member having an end portion and an inlet for receiving fluid;
- nozzle means connected at said end portion of said tube-like member;
- means for providing a high-pressure fluid jet escaping from said nozzle means;
- guiding means for enabling said tube-like member to displace in axial direction;
- supporting means comprising a pyramid-shaped cage-like supporting member including a lower supporting plate for pivotally supporting in all directions said end portion of said tube-like member at which said nozzle means is connected, said lower supporting plate including a bearing shell in which said nozzle means is flexibly received.

4. An apparatus for cutting a plain, curved or arched workpiece by a beam-shaped fluid cutting medium ejected under high pressure, said apparatus comprising:
- a tube-like member having an end portion and an inlet for receiving fluid;
- nozzle means connected at said end portion of said tube-like member;
- means for providing a high-pressure fluid jet escaping from said nozzle means;
- guiding means including an upper guiding member adjustable in two directions extending perpendicular to each other for enabling said tube-like member to displace in axial direction; and
- supporting means comprising a pyramid-shaped cage-like supporting member including a lower supporting plate for pivotally supporting in all directions said end portion of said tube-like member at which said nozzle means is connected, said pyramid-shaped cage-like supporting member comprising bar member means and an upper tetragonal frame member and a lower frame member, said lower frame member being smaller than said upper frame member, said upper and lower frame members being connected to each other by said bar member means.

5. An apparatus according to claim 4 wherein said guiding means includes a supporting bridge member, said upper guiding member of said guiding means being an L-shaped supporting plate slidably connected to said supporting bridge member, said L-shaped supporting plate having an aperture for receiving said tube-like member such that said tube-like member is displaceable in axial direction.

6. An apparatus according to claim 4 wherein said upper tetragonal frame member has square or rectangular shape and comprises a first pair of parallely running frame side bars extending in X-direction and a second pair of parallely running frame side bars extending in Y-direction, said X-and Y-directions being perpendicular to each other.

7. An apparatus according to claim 6 wherein said upper frame member comprises a first spindle and first motor means adapted to rotate said first spindle, said first spindle extending in said X-direction, and a second spindle and second motor means adapted to rotate said second spindle, said second spindle extending in said Y-direction, said first spindle being parallely displaceable along said second frame side bars in said Y-direction and said second spindle being parallely displaceable along said first frame side bars in said X-direction.

8. An apparatus according to claim 7 wherein said upper guiding member of said guiding means comprises at least two threaded protrusions projecting from two adjacent edges thereof, said first spindle being operatively connected to one of said protrusions and said second spindle being operatively connected to said other one of said protrusions.

* * * * *